United States Patent [19]

Taylor

[11] 4,224,518

[45] Sep. 23, 1980

[54] MULTISTAGE CYLINDRICAL MIRROR ANALYZER INCORPORATING A COAXIAL ELECTRON GUN

[75] Inventor: Norman J. Taylor, Los Altos, Calif.

[73] Assignee: Varian Associates, Inc., Palo Alto, Calif.

[21] Appl. No.: 972,192

[22] Filed: Dec. 21, 1978

Related U.S. Application Data

[63] Continuation of Ser. No. 822,766, Aug. 8, 1977, abandoned.

[51] Int. Cl.[3] ..... H01J 39/00

[52] U.S. Cl. ..... 250/305; 250/310

[58] Field of Search ..... 250/305, 310, 309, 308

[56] References Cited

U.S. PATENT DOCUMENTS

| | | | |
|---|---|---|---|
| 3,699,331 | 10/1972 | Palmberg | 250/305 |
| 3,739,170 | 6/1973 | Bohn | 250/305 |
| 3,787,692 | 1/1974 | Anderson | 250/305 |
| 3,920,990 | 11/1975 | Niewwland | 250/309 |
| 3,935,453 | 1/1976 | Liebl | 250/292 |
| 4,107,526 | 8/1978 | McKinney et al. | 250/309 |

OTHER PUBLICATIONS

Annal der Physik, vol. 39, 1941, p. 62.

*Primary Examiner*—Harold A. Dixon

*Attorney, Agent, or Firm*—Stanley Z. Cole; Edward H. Berkowitz

[57] ABSTRACT

A multi-stage cylindrical mirror analyzer incorporates a primary radiation source, such as an electron gun, disposed internally and along the axis of the multi-stage analyzer. The gun includes all of the optical elements for producing a well defined beam, correcting aberration thereof and scanning the beam on a sample. The components of the gun are distributed along the axial length of the analyzer. Aberration of the scanned beam due to traversal of a subsequent lense is minimized by placing the pivot point of the deflected beam trajectory substantially at the center of the lense. The greater dispersion of the multi-stage analyzer and the unit magnification thereof permit proportionately greater exit aperture dimensions, whereby a wider field of view may be realized.

4 Claims, 2 Drawing Figures

MULTISTAGE CYLINDRICAL MIRROR ANALYZER INCORPORATING A COAXIAL ELECTRON GUN

This is a continuation of application Ser. No. 822,766, filed Aug. 8, 1977 now abandoned.

FIELD OF THE INVENTION

This invention relates to the field of surface analysis apparatus and in particular to the combination of a charged particle gun and a cylindrical mirror analyzer.

BACKGROUND OF THE INVENTION

A study of surfaces and near surface composition of a sample is accomplished with a well collimated ion or electron beam to impinge the sample and an efficient analyzer for the secondary radiations scattered or evolved from the surface. A well-known form of such apparatus is the cylindrical mirror analyzer (CMA) with internal axially aligned electron source. A representative example of such prior art apparatus is the Varian Model 981-2707 cylindrical mirror analyzer and integral gun, Model 981-2773. This apparatus comprises coaxial cylinders with an electron gun disposed along the common axis and surrounded by the inner cylindrical wall of the analyzer.

It has been known previously to employ multiple stages of cylindrical analyzers and the theoretical analyses of the optics thereof is well understood.

SUMMARY OF THE INVENTION

It is an object of the invention to achieve improved energy resolution and geometric resolution over a wide field of view for surface analytic apparatus such as an Auger microprobe incorporating electrostatic analysis by cylindrical mirrors.

In one feature of the invention, an electron gun is disposed along the internal length of the common axis of a multi-stage CMA.

In another feature of the invention, the field of view over which a nearly constant intensity excitation beam may be swept, for fixed range of variation in analyzer response, is increased approximately by a factor n where n is the number of stages of the analyzer.

In yet another feature of the invention, aberration of the deflected beam due to traversal of a subsequent lense is minimized by pivoting the deflected beam about the center of the lense.

This object and features are accomplished by disposing a charged particle gun including all of its attendant optical elements along the axis of a multi-stage CMA. The various elements of the gun are distributed internally within the several sections of a multi-stage CMA. The greater dispersion afforded by the multi-stage CMA permits a wider field of view for given energy resolution and geometric resolution.

DETAILED DESCRIPTION OF THE INVENTION

Figure 1:
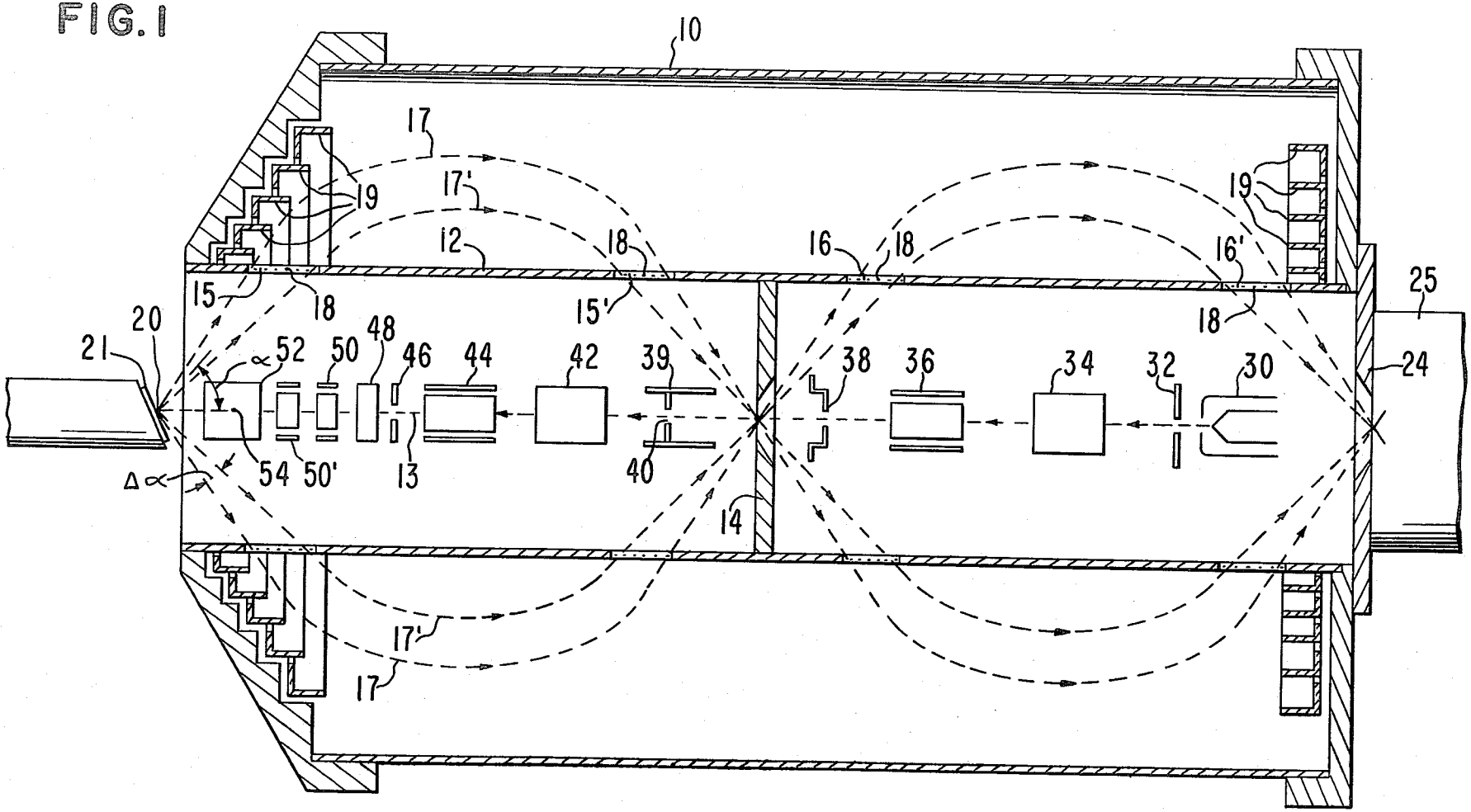
FIG. 1 is a schematic section of the apparatus of the preferred embodiment.

A preferred embodiment of the invention comprises a two-stage CMA and axially disposed electron gun as illustrated in FIG. 1. For the purposes of this discussion "electron gun" refers to the entire beam forming and scanning apparatus. The two-stage CMA portion of the apparatus comprises a pair of spaced coaxial metal cylinders 10 and 12 with respective radii $r_{10}$ and $r_{12}$ arranged on axis 13. These cylinders form a cylindrical capacitor characterized by a radially directed electric field in the space therebetween. The inner cylinder has an intermediate aperture 14 located at the midpoint of the axis which divides the stages of the CMA. Secondary electrons from the sample pass through this aperture 14 if their energies are within the energy band selected by the CMA. The principal purpose of aperture 14 is to prevent electrons which pass through the first stage from striking elements of the electron gun and scattering into the second stage.

Nearly annular slots 15 and 15' are formed in the inner cylinder to permit entrance and exit respectively of the particle trajectories under analysis into the radial electric field space between cylinders 10 and 12. Similar slots 16 and 16' serve similar purposes for the second stage of the analyzer. These slots are each conventionally gridded by mesh 18 to preserve a generally equipotential cylindrical surface and prevent unwanted electric field distortion due to the discontinuities introduced by the presence of the slots.

End effects introduce distortions of the electric field for finite length cylinders. These are relieved in a well known manner by a system of guard rings 19 for dividing the potential between cylinders with a resistive network (not shown). The extreme trajectories 17 and 17' are defined with respect to a focus 20. A sample surface 21 is positioned at focus 20. It will be appreciated that the sample is situated in a vacuum enclosure although such enclosure does not appear in FIG. 1. The focal distance determines the location of the focus and is a design parameter of the analyzer. This parameter and radii $r_{10}$ and $r_{12}$ geometrically determine $\alpha$, the mean angle of analyzer acceptance, as measured with respect to the analyzer axis. Optimum values for $\alpha$ may be found for given relative dimensions of the CMA according to well-known analytic treatments. In each stage of the CMA, the entrance and exit apertures are preferably symmetrically disposed on the axis with respect to the midplane from each of the respective stages and the stages are themselves symmetrically disposed in respect to intermediate aperture 14. In general, the two stages need not be identical (or symmetrically disposed with respect to the midplane). For example, a shorter second stage may be achieved if the electric field in the second stage is appropriately increased. It will readily occur to one skilled in the art to accomplish this end by employing the same potential difference between the cylinders while decreasing the inner-electrode space, as for example by increasing the inner radius.

Final aperture 24 defines the image point which is preferably located symmetrically with the object point. Aperture 24 may be a simple circular hole as shown, or annular if displaced along the axis toward the intermediate aperture 14. The dimensions of aperture 24 are selected to accept a portion of the trajectories transmitted by the analyzer. In a preferred form, aperture 24 may be variable in its dimensions to permit selection of a particular narrow band of trajectories defined by the analyzer. This may be accomplished readily by providing a hermetically sealed rotary feedthrough not shown to position a desired aperture at the indicated position.

Particle detector 25 such as, for example, an electron multiplier, or a scintillator and photomultiplier is provided for detection of the particles transmitted by the analyzer and aperture 24.

A particle beam source, as for example, an electron gun, is disposed on the axis of the CMA as described below. Such a gun comprises an electron source 30, anode 32 for establishment of the longitudinal accelerating fields for the beam, 1st lense 34 alignment plates 36, anti-scattering aperture 38 and secondary electron suppression tube 39 with defining aperture 40 located therein, second electrostatic lens 42, a second set of alignment plates 44, objective aperture 46, stigmator assembly 48, deflector plates 50 and 50' and final lens 52. Other electron optical elements may be inserted in the space available, as may be desired.

Because the primary beam passes through the same region as the analyzed beam, it is essential that the primary beam be carefully collimated to remove the possibility of scattering or secondary electron emission consequent to the primary beam striking intermediate aperture 14 or other structure in this region. Aperture 38 is carefully designed and positioned to prevent the entrance of such stray electrons into the second stage of the analyzer. Aperture 38 also serves a beam restrictive function. By minimizing the number of electrons passing through the front focal region of the second part of the analyzer, scattering from residual gas molecules in this region is minimized and can be reduced to a negligible level. Two sets of alignment plates 36 and 44 are provided to align the beam with respect to the respective apertures 40 and 46 whereas deflection plates 50 and 50' provide transverse deflection for scanning the sample. The electrostatic lenses may be cylindrical, multiple aperture or quadrupole lenses as may be required for desired optical properties.

Figure 2:
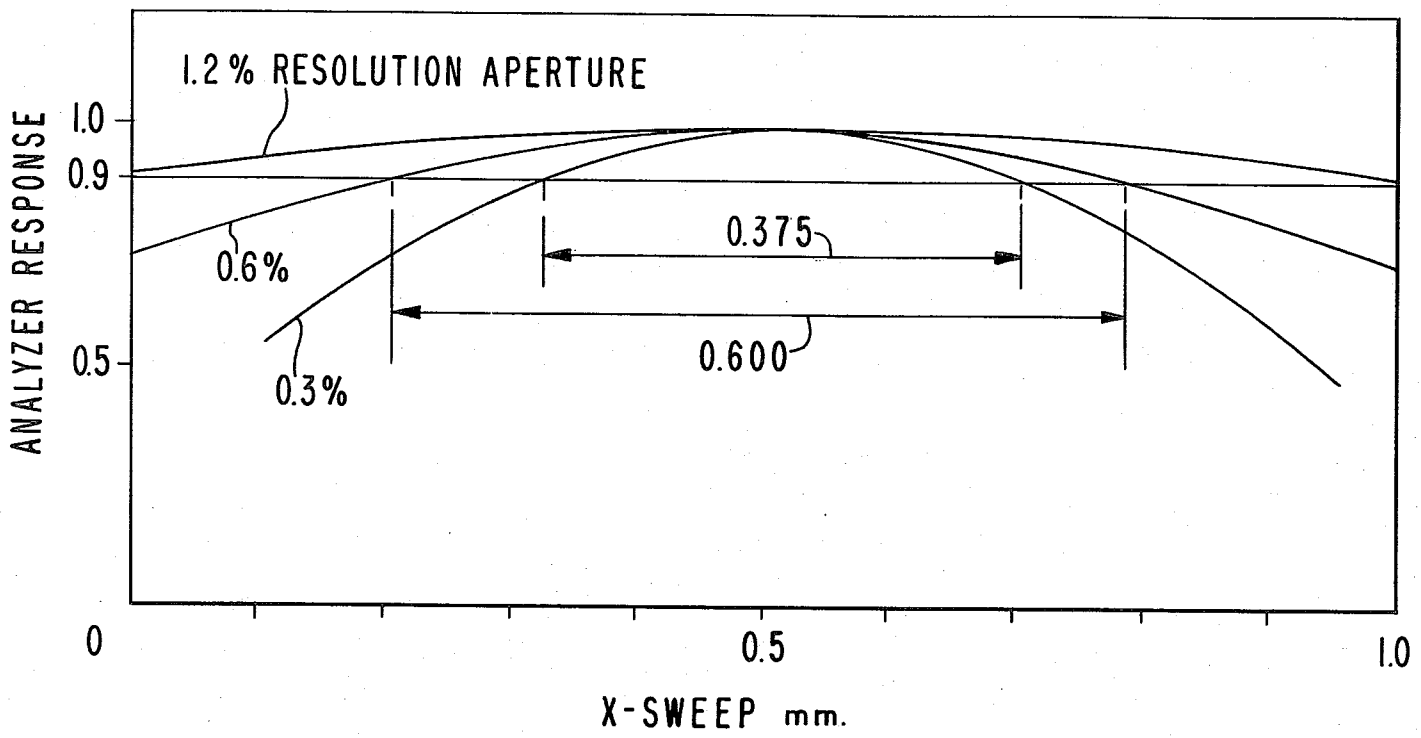
FIG. 2 illustrates the response of the instrument for a scanned beam.

The distribution of the elements of the electron gun along the axis of the two-stage CMA entails a division of components including all of the attendant electron optics, among the axial spaces of both stages of the CMA. Because the beam is often employed to scan a sample, certain benefits innure to the combination of an n-stage CMA with an internal axial gun. For example, a two-stage CMA possesses twice the dispersion, E ($\Delta z/\Delta E$), compared to a single stage CMA where E is the particle energy and z is the axial displacement of the intersection of trajectories. This remains true, although comparable single and two-stage instruments both possess magnification of unity and identical resolution. Because of the increased dispersion, the exit aperture 24 will be twice the diameter of the aperture of the comparable single stage analyzer for accepting the same energy band of trajectories. A magnification of unity for both instruments means that displacement of the beam on the object results in roughly equal displacement of the image thereof at the exit of the analyzer. Because of the greater dimension of this aperture, the beam may be scanned over a wider field of view, approximately twice that of the comparable single stage device for the same analyzer reduction and signal attenuation at the edges of the field of view. FIG. 2 illustrates the beam displacement dependence for response of the analyzer to an elastically scattered peak as the beam is swept across the sample. The response measurement is shown for each of three different values of resolution as determined by aperture dimension for exit aperture 24. Normailization of the curves permits comparison of the various resolutions for the extent of lateral sweep which incurs no more than 10 percent variation in analyzer response.

While an n stage analyzer effectively widens the useful field of view by a factor approximately n, the effect is not without limit in angular width, nor for the number of stages. The angular width cannot be increased to the extent that the trajectories depart substantially from the acceptance angle $\alpha$ without incurring aberrations in the analyzer which degrade its resolution. For example, displacement of the object point from the axis will introduce a component in the electron trajectories which lay outside of a single radial plane. Greater displacements will produce trajectories, each of which to a greater degree contain a non-coplanar component. The non-coplanar component of motion ultimately degrades analyzer resolution and limits the performance of the instrument. Non-coplanar trajectories could be removed, for example by means of radial baffles, with consequent reduction in intensity of the detected signal.

It will also be apparent that displacement of the trajectories 17 and 17' is also limited by components of the electron gun whereby large deflection of the incident beam results in trajectories which are not unobstructed over the entire annular acceptance region of the analyzer.

Utility of the principle of plural stages of analysis is finally limited by the cumulative effect of aberrations in the several stages of such an analyzer.

The electron gun of the preferred embodiment is arranged to place the final lense 52 close to the sample. Minimizing the distance to the sample from the final lense has the effect of minimizing the effect of spherical aberration, permitting greater beam concentration for a given beam diameter. Deflection plates 50 therefore precede lense 50. It has been found that aberration in the deflected (and thus non-paraxial) beam upon traversal of lense 52 is minimized by the artifice of arranging the deflection plates 50 and voltages applied thereto to pivot the beam substantially about the center 54 of lense 52. This is accomplished by dividing the deflectors into two units displaced by an intermediate drift space. Each unit comprises both x and y deflection plates. An "essing" technique is then utilized to direct the "essed" beam to cross the beam transport axis at a predetermined position. For example, y deflection is accomplished by first deflecting the beam away from the axis with the y plates of deflection plates 50 and the beam is then returned to the axis by the y plates of deflection plates 50'. The same potential difference (with polarity reversed) may be applied to both pairs of y deflection plates. The dimensions of the plates are chosen to cause the beam to cross the beam transport axis after the second deflection at center 54 of the lense 52. For a symmetrical lense, the center is understood to be the geometrical center. The technique is also applicable to an asymmetric lense wherein the center is understood to be the optical center of the asymmetric lense.

Typical design parameters for the preferred embodiment include variable electron beam energy over the range from 100 ev to 10 Kev with optics sufficient to achieve a parallel beam of circular cross section with diameter ranging from 0.2 micron or less, to 10 microns. The voltages which are applied to the various optical elements, such as lenses, alignment plates, stigmators, deflection plates, etc., are arranged to track the beam energy in order to preserve the geometric properties of the beam over the beam energy range. The design for achieving these specifications is well known and beyond the scope of this work. Accordingly, the details of the optical elements are not further elaborated.

The physical dimensions of the preferred embodiment include outer radius $r_{10}=6$ cm and inner radius $r_{12}=2.5$ cm. The preferred embodiment has a mean angle of acceptance ($\alpha$) of 42.44° with an angular spread of ±6°. The length between object and image focii is 13.091 inches. The intermediate aperture may assume dimensions ranging from 2 mm to 4 mm: where desired, a smaller diameter is used to function as a defining aperture thereby limiting the transmission of the analyzer.

Although the invention has been shown and described with reference to preferred embodiments, it will be readily apparent to one of average skill in the art that various changes in the form and arrangement of the parts may be made to satisfy requirements without departing from the scope of the invention as defined by the dependent claims. It will be apparent, for example, that the invention is not limited to electron excitation and that the principals taught herein are equally applicable for similar studies wherein ion beams are employed. It will also be apparent that electromagnetic excitation of photoelectrons can utilize the principals of the invention especially where a spacially coherent radiation source, as for example a laser, is mounted in the interior of the mult stage CMA.

What is claimed is:

1. The method of minimizing the aberration of a scanning charged particle beam, said scanning introduced by deflecting said beam transverse to an axis of beam transport, said aberration introduced by passing said scanning beam through an electro-optical lense on said axis, comprising deflecting said beam away from said axis in a first deflection region, deflecting said beam toward said axis in a second deflection region, said latter deflection causing said beam to cross said axis at the center of said lense.

2. The method of claim 1 wherein said step of deflecting the beam away from said axis is followed by the step of permitting said deflected beam to traverse a drift space.

3. The method of claim 1 wherein said center of said lense is the geometric center of symmetric lense.

4. The method of claim 1 wherein said center of said lens is the optical center of an asymmetrical lens.

* * * * *